US010227959B2

(12) United States Patent
Pieper et al.

(10) Patent No.: US 10,227,959 B2
(45) Date of Patent: Mar. 12, 2019

(54) HIGH-PRESSURE FUEL PUMP

(71) Applicant: Continental Automotive GmbH, Hannover (DE)

(72) Inventors: Sascha Pieper, Isernhagen (DE); Stefan Dierks, Wörth (DE); Andreas Ellenberg, Roding (DE); Hans-Jörg Koch, Brennberg (DE)

(73) Assignee: CPT GROUP GMBH, Hannover (DE)

( * ) Notice: Subject to any disclaimer, the term of this patent is extended or adjusted under 35 U.S.C. 154(b) by 0 days.

(21) Appl. No.: 15/735,744

(22) PCT Filed: Jun. 2, 2016

(86) PCT No.: PCT/EP2016/062526
§ 371 (c)(1),
(2) Date: Dec. 12, 2017

(87) PCT Pub. No.: WO2016/198314
PCT Pub. Date: Dec. 15, 2016

(65) Prior Publication Data

US 2018/0180008 A1 Jun. 28, 2018

(30) Foreign Application Priority Data

Jun. 12, 2015 (DE) ..... 10 2015 210 795

(51) Int. Cl.

| | |
|---|---|
| ***F02M 59/48*** | (2006.01) |
| ***F02M 59/02*** | (2006.01) |
| ***F04B 1/04*** | (2006.01) |
| ***F04B 53/16*** | (2006.01) |
| ***F04B 53/22*** | (2006.01) |

(52) U.S. Cl.
CPC ..... *F02M 59/48* (2013.01); *F02M 59/02* (2013.01); *F02M 59/027* (2013.01); *F04B 1/0404* (2013.01); *F04B 53/16* (2013.01); *F04B 53/22* (2013.01)

(58) Field of Classification Search
CPC ..... F02M 59/48; F02M 59/02; F02M 59/027; F04B 1/0404; F04B 53/16; F04B 53/22
See application file for complete search history.

(56) References Cited

U.S. PATENT DOCUMENTS 6,406,278 B1 * 6/2002 De Matthaeis ..... F02M 55/00 137/454.4
2011/0073076 A1 3/2011 Lazich

FOREIGN PATENT DOCUMENTS

DE 2612973 A1 10/1976
DE 102011088293 A1 6/2013
(Continued)

OTHER PUBLICATIONS

International Search Report and Written Opinion dated Sep. 6, 2016 from corresponding International Patent Application No. PCT/EP2016/062526.

(Continued)

*Primary Examiner* — Hieu T Vo

(57) ABSTRACT

The invention relates to a high pressure fuel pump (10) comprising a housing (12) and a flange (14) by means of which the housing (12) can be fastened to an engine block or cylinder head, the flange (14) being formed of at least two flange parts (26) that are separate from the housing (12) and are separated from each other, and that overlap mutually in the fastened state of the housing (12).

12 Claims, 3 Drawing Sheets

(56) References Cited

FOREIGN PATENT DOCUMENTS

Figure 1:
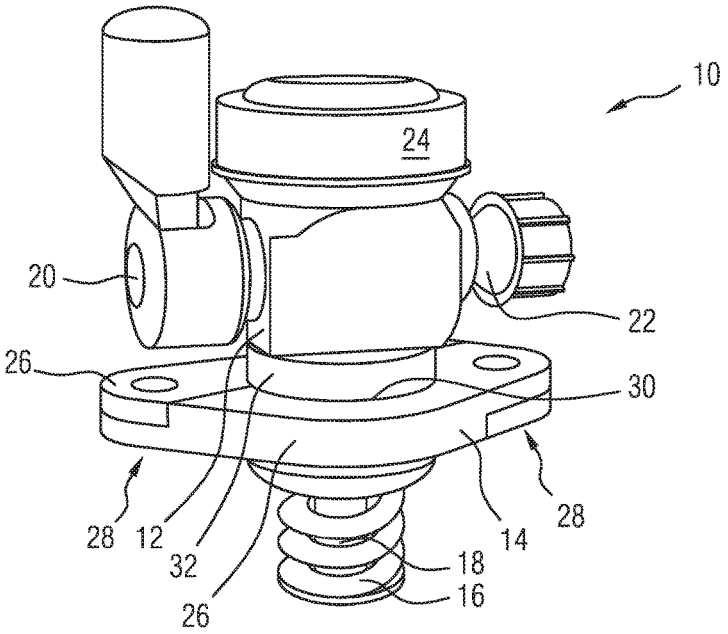

| | | | | | |
|---|---|---|---|---|---|
| DE | 102013204549 | A1 | | 9/2014 | |
| JP | 2011220200 | A | * | 11/2011 | ..... F02M 59/44 |
| WO | 2014139697 | A1 | | 9/2014 | |

OTHER PUBLICATIONS

German Office Action dated Apr. 29, 2016 from corresponding German Patent Application No. 10 2015 210 795.7.

* cited by examiner

HIGH-PRESSURE FUEL PUMP

The invention relates to a high pressure fuel pump for loading a fuel with high pressure.

High pressure fuel pumps in fuel injection systems are used to load a fuel with a high pressure, the pressure lying, for example, in the range from 250 bar to 400 bar in the case of gasoline internal combustion engines and in the range from 1500 bar to 3000 bar in the case of diesel combustion engines. The higher the pressure which can be generated in the respective fuel, the lower the emissions which are produced during the combustion of the fuel in a combustion chamber, which is advantageous, in particular, against the background that a reduction in emissions is desired to an ever greater extent.

In order for it to be possible to achieve the high pressures in the respective fuel, said high pressure fuel pumps are usually configured as piston pumps, a pump piston being driven by an eccentric shaft. Here, said eccentric shaft is mounted in a cylinder head or in an engine block, with the result that the high pressure fuel pump is fastened to the engine block or to the cylinder head in order to bring the pump piston into contact with the eccentric shaft.

A flange is usually used for fastening the high pressure fuel pump, which flange is fastened to a housing of the high pressure fuel pump by means of a welded seam, that is to say in an integrally joined manner.

The flange is fixed firmly on the housing of the high pressure fuel pump by way of the welded seam, with the result that reorientation of the flange is no longer possible after fastening to the housing of the high pressure fuel pump.

As a result, it is also no longer possible to attach the high pressure fuel pump with the flange which is fastened to it flexibly to different cylinder heads or engine blocks, in the case of which the available installation space can be of different configuration in terms of shape and size.

It is therefore an object of the invention to provide a high pressure fuel pump which is flexible with regard to the fastening to a cylinder head or engine block.

Said object is achieved by way of a high pressure fuel pump having the features of claim 1.

Advantageous refinements of the invention are the subject matter of the dependent claims.

A high pressure fuel pump for loading a fuel with high pressure has a housing for receiving at least one high pressure generating element for generating a high pressure in the fuel, and a flange for fastening the housing to a cylinder head and/or to an engine block of an internal combustion engine. The flange is configured separately from the housing and has at least two flange parts which are separated from one another and are configured to engage around in each case one part circumferential region of the housing. Furthermore, the flange parts are configured in such a way that they overlap mutually in the fastened state of the housing.

By virtue of the fact that the flange has at least two flange parts which are separated from one another and engage in each case around only one part circumferential region of the housing, a free orientation of the high pressure fuel pump is possible, the requirements made of the flange, such as holding down the high pressure fuel pump, without excessive ventilating, and the fixing function, nevertheless being fulfilled. By virtue of the fact that the flange parts which are separated from one another overlap mutually in the fastened state of the housing, a high stability of the overall arrangement and a sealed fastening of the high pressure fuel pump can be achieved.

Each flange part preferably has a first flange part end region and a second flange part end region, the flange parts being configured in such a way that they overlap both in the first flange part end region and in the second flange part end region in the fastened state of the housing. The more regions of the flange parts which overlap mutually, the greater is advantageously the stability of the flange which results from the overlap of the individual flange parts.

Each flange part advantageously has a first flange plane and a second flange plane which are arranged offset in parallel with respect to one another, the first flange part end region being arranged in the first flange plane, and the second flange part end region being arranged in the second flange plane. Each flange part therefore advantageously has a step, via which the two flange planes are connected to one another. In the region of said step, two flange parts can then advantageously overlap one another, to be precise preferably in such a way that one of the two flange parts in the overlap region provides the first flange plane and the other of the two flange parts provides the second flange plane. Despite the overlap, a flange can thus be formed from the individual flange parts, which flange is advantageously formed without steps in the fastened state and therefore has a level surface.

Each flange part advantageously has at least one screw hole for guiding through a fastening bolt in the first and in the second flange part end region. The flange parts are advantageously configured in such a way that the screw holes of the first flange part and of the second flange part overlap in the fastened state of the housing. During fastening of the high pressure fuel pump via the flange which is formed from the flange parts, a plurality of effects can therefore be achieved via a single bolt. Firstly, the single bolt fastens the two flange parts to one another, since said individual bolt extends through in each case one screw hole of the one flange part and one screw hole of the other flange part; secondly, the bolt also at the same time fastens the entire flange to the cylinder head or the engine block. Not only secure fastening, but rather also an orientation with respect to one another of the individual parts which are fastened to one another can therefore advantageously be achieved by way of the overlap of the screw holes of the separated flange parts.

Each flange part preferably has a partially circular recess for receiving the part circumferential region of the housing. A contact web for acting on the part circumferential region is configured in the recess. As a result, each flange part can advantageously be supported on the housing of the high pressure fuel pump and can therefore apply a fastening force to the housing of the high pressure fuel pump. Final fastening of the flange parts to the housing is therefore no longer necessary, in contrast to the fastening by way of a welded seam, and the flexibility of the high pressure fuel pump with regard to the installation orientation is advantageously maintained.

The contact web advantageously extends merely partially in the recess, in particular over between 50% and 80% of the partially circular recess. The contact web is particularly advantageously not present in the region, in which the flange part under consideration overlaps with another flange part. If two flange parts which are separated from one another are advantageously provided for forming the flange, it is advantageous if the contact web is present in the recess in a first overlap region, and not in a second overlap region, since the individual flange parts complete one another as a result of the overlap of the individual flange parts, and a contact web which encircles the housing completely can thus preferably be formed via the overlap.

In the fastened state of the housing, each flange part preferably extends over more than half of a housing circumference of the housing. In said advantageous refinement, two flange parts are preferably provided which together form the flange for fastening the housing. The fewer individual flange parts which are separated from one another are provided, the more stable and secure the orientation of the individual flange parts with respect to one another and the resulting flange can be configured.

The at least two flange parts are advantageously of identical configuration with respect to one another, as a result of which particularly inexpensive production of the flange can be achieved in accordance with the advantageous principle of identical parts.

Each flange part is preferably of rotationally symmetrical configuration about a center axis which divides the flange part centrally between the first flange part end region and the second flange part end region. As a result of the rotational symmetry about the center axis, each flange part can then be used in every position, that is to say the flange part can simply also be rotated about the center axis by 180°, and thus forms the flange part which is complementary with respect to itself in order to form the entire flange.

In the fastened state of the housing, the flange which is formed from the at least two flange parts advantageously surrounds a housing circumference of the housing completely. As a result, particularly secure fastening of the housing to the cylinder head or the engine block can advantageously be achieved.

The housing advantageously has a circumferential projection, on which the at least two flange parts are supported. As an alternative, it is also possible that the housing has a groove which is of complementary configuration with respect to in each case one supporting region of the at least two flange parts, and into which groove the respective supporting region engages.

Secure fastening of the flange to the housing is achieved by way of the two possible embodiments, and the fastening force is transmitted particularly satisfactorily from the flange to the housing in order to hold down the housing.

Figure 2:
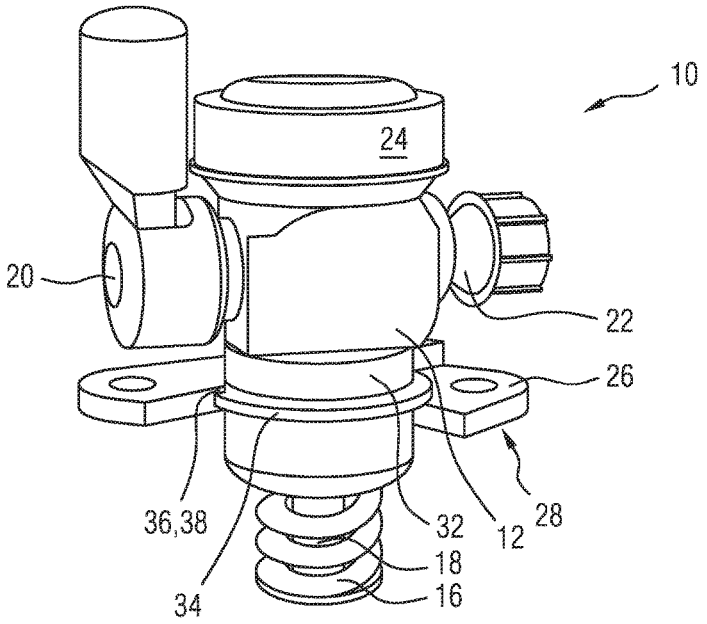
Figure 3:
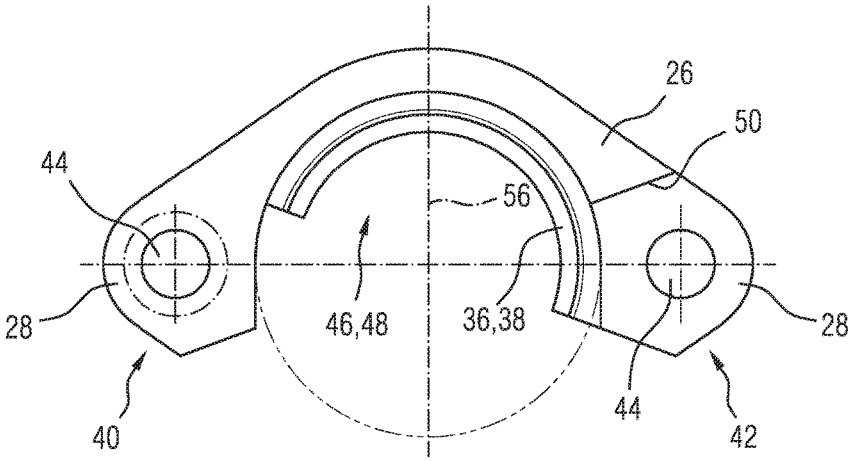
Figure 4:
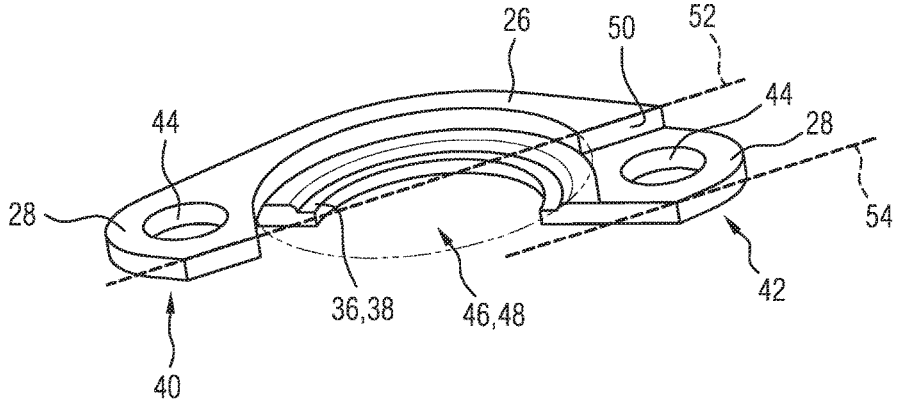
Figure 5:
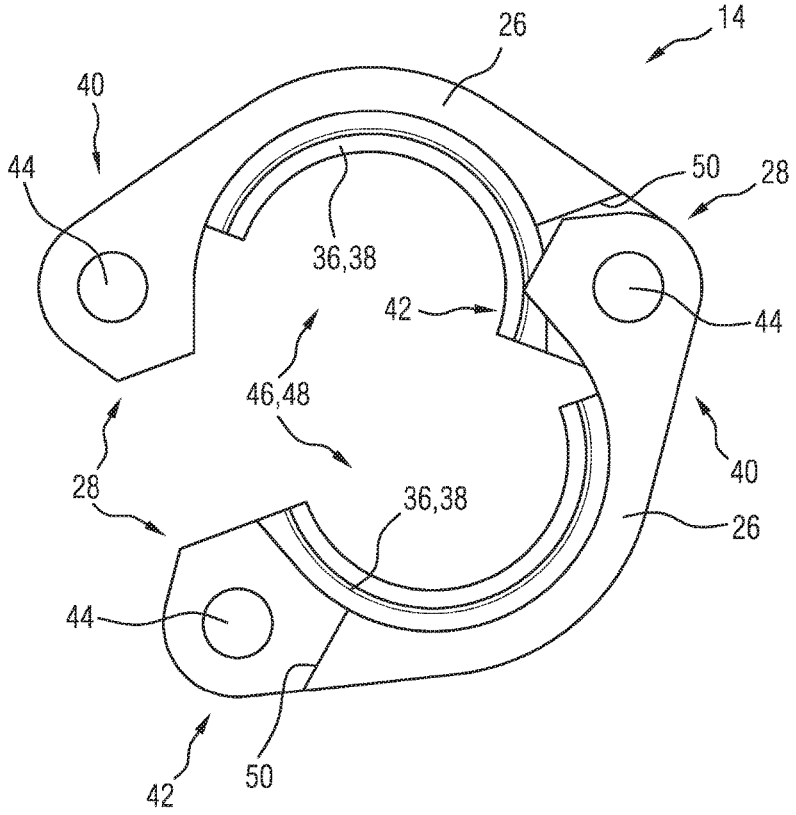

One advantageous refinement of the invention will be described in greater detail in the following text using the appended drawings, in which:

FIG. 1 shows a perspective illustration of a high pressure fuel pump having a flange for fastening the high pressure fuel pump to a cylinder head or to an engine block, FIG. 2 shows a perspective illustration of the high pressure fuel pump from FIG. 1, a flange part of the flange having been removed, FIG. 3 shows a plan view of the flange part which remains on the high pressure fuel pump in FIG. 2, FIG. 4 shows a perspective illustration of the flange part from FIG. 3, and FIG. 5 shows a plan view of two flange parts according to FIG. 3 and FIG. 4, which flange parts overlap in an overlap region.

FIG. 1 shows a perspective illustration of a high pressure fuel pump 10 which has a housing 12 and a flange 14.

At least one high pressure generating element 16, such as a pump piston 18, is accommodated in the housing 12, and an inflow line 20, an outflow line 22 and a damper 24 are fastened thereto.

In order for it to be possible to fasten the housing 12, for example, to a cylinder head or an engine block of an internal combustion engine, with the result that a drive element, such as an eccentric shaft, can drive the pump piston 18 in a translational movement, the flange 14 is provided which holds down the housing 12 on the cylinder head or the engine block.

This is because, in order for it to be possible to provide the function of the high pressure fuel pump 10 which is configured as a piston pump and is to be integrated in a fuel injection system of an internal combustion engine, the high pressure fuel pump 10 has to be fixed on the engine block or the cylinder head by means of the flange 14. Said flange 14 is normally attached on the high pressure fuel pump 10 by means of a welded seam, that is to say in an integrally joined manner. The welded seam does not permit any reorientation of the flange 14, however, which can lead to increased problems with regard to time-critical example constructions, for example, in a tendering phase. The high pressure fuel pump 10 is therefore normally mounted on the cylinder head or the engine block via bolts by means of a fixedly welded flange 14 on the housing 12. Said flange 14 does not permit any subsequent reorientation of the high pressure fuel pump 10 which might possibly be useful in the case of installation space tests. The flexibility and therefore the orientation possibilities are limited merely to the predefined orientation of the high pressure fuel pump 10.

A flange 14 is therefore then arranged on the high pressure fuel pump 10 according to FIG. 1, which flange 14 represents a split flange concept which permits a free orientation of the high pressure fuel pump 10 and nevertheless fulfills the requirements made of the flange 14, such as holding down the high pressure fuel pump 10, without excessive ventilating, and the fixing function. As a result of the multiple-piece flange concept, the delivery time of samples is shortened considerably, and a welding step can be dispensed with.

The flange 14 in FIG. 1 has two flange parts 26 which are separated from one another and are connected to form an overall flange 14 by way of an overlap in two overlap regions 28. Here, each flange part 26 engages around in each case one part circumferential region 30 of the housing 12. The two flange parts 26 together, as an overall flange 14, engage completely around the housing circumference 32 of the housing 12.

FIG. 2 shows the high pressure fuel pump 10 from FIG. 1, likewise in a perspective illustration, one of the two flange parts 26 having been removed.

It can be seen that, in the present embodiment, the housing 12 has a circumferential projection 34, on which the flange parts 26 can be supported, to be precise by way of a supporting region 36 which lies on the projection 34. In the present embodiment, the supporting region 36 is formed as a contact web 38 which will be described in greater detail in the following text. As an alternative to the projection 34, it is also possible to provide a groove on the housing 12, which groove is of complementary configuration with respect to the supporting region 36, with the result that the flange parts 26 can engage into the groove, and can thus apply a fastening force to the housing 12.

As is apparent from FIG. 2, each flange part 26 extends over more than half of the housing circumference 32, with the result that an overlap is possible in the overlap regions 28 of the two flange parts 26. Instead of a two-piece flange arrangement, it is also possible to provide a plurality of individual flange parts 26 which are configured separately from one another and in a separated manner from the housing 12; more overlap regions 28 are then accordingly also arranged on the flange 14.

In the preferred refinement, in which two flange parts 26 are provided, they are of identical configuration with respect to one another, with the result that the principle of identical parts can be applied and a cost advantage arises in the production of the individual flange parts 26.

The configuration of the individual flange parts 26 will be described in greater detail in the following text with reference to FIG. 3 and FIG. 4.

FIG. 3 shows a plan view of a flange part 26, whereas FIG. 4 shows a perspective view of the flange part 26 from FIG. 3.

The flange part 26 has a first flange part end region 40 and a second flange part end region 42, in which in each case one screw hole 44 is arranged. As is apparent from FIG. 1, two flange parts 26 overlap precisely in said two flange part end regions 40, 42. This means that the screw holes 44 which are situated in said flange part end regions 40, 42 in the two flange parts 26 also overlap in the fastened state of the housing 12, and that a fastening bolt is plugged jointly through two overlapping screw holes 44. The two flange parts 26 are thus not only fastened to one another such that they cannot be moved with respect to one another, but rather at the same time the housing 12 is also fastened to the cylinder head or the engine block.

Each flange part 26 has a partially circular recess 46, by way of which the flange part 26 surrounds the part circumferential region 30 of the housing 12. The contact web 38 is arranged in said recess 46, by way of which contact web 38 the respective flange part 26 is supported on the projection 34 of the housing 12. The contact web 38 does not extend completely over the circumference of the recess 46, but rather merely partially over the recess 46, preferably over between 50% and 80% of the partial circle 48 which is formed by the recess 46. The two contact webs 38 complete one another by way of the overlap of the two flange parts 26 in the overlap regions 28, with the result that, in the assembled state of the two flange parts 26, a contact web 38 is provided on the flange 14, which contact web 38 can be supported over the entire housing circumference 32 on the projection 34 of the housing 12.

Each flange part 26 has a step 50, with the result that the flange part 26 comprises a first flange plane 52 and a second flange plane 54. Said step 50 and the two flange planes 52, 54 can be seen particularly clearly in the perspective illustration in FIG. 4. The two flange planes 52, 54 are arranged offset in parallel with respect to one another, in order thus to form the step 50. The flange part end regions 40, 42, in which the flange parts 26 which are to be connected to one another overlap, are not arranged in one plane, but rather the first flange part end region 40 is arranged in the first flange plane 52 and the second flange part end region 42 is arranged in the second flange plane 54. In the case of an overlap of two flange parts 26 in said flange part end regions 40, 42, this results in an overall flange 14 which is of level configuration on its surface.

Each flange part 26 is of rotationally symmetrical configuration about a center axis 56 which divides the flange part 26 centrally between the first flange part end region 40 and the second flange part end region 42, as can be seen in FIG. 3. If the flange part 26 is rotated by 180° about said center axis 56, its outer shape is transformed into itself. As a result, the same flange part 26 can be used in FIG. 1 both as a flange part 26 which is arranged at the rear and as a flange part 26 which is arranged at the front, merely in each case in a rotated form.

FIG. 5 shows a plan view of two flange parts 26 which already overlap partially in one of the overlap regions 28. If the two flange parts 26 are also pushed together in the opposite overlap region 28, they together form the overall flange 14 which can then hold down the housing 12 of the high pressure fuel pump 10 on a cylinder head or on an engine block.

The invention claimed is:

1. A high pressure fuel pump comprising:

a housing configured to receive at least one high pressure generating element for generating a high pressure in the fuel;

a flange configured to fasten the housing to at least one of a cylinder head and an engine block of an internal combustion engine, the flange being separate from the housing and comprising at least two flange parts, the flange parts separated from one another and each configured to engage around a respective part circumferential region of the housing, the flange parts configured to overlap mutually in the fastened state of the housing.

2. The high pressure fuel pump as claimed in claim 1 wherein each flange part comprises a first flange part end region and a second flange part end region, the flange parts configured to overlap both in the first flange part end region and in the second flange part end region in the fastened state of the housing.

3. The high pressure fuel pump as claimed in claim 2 wherein each flange part defines a first flange plane and a second flange plane, the flange planes offset in parallel with respect to one another, the first flange part end region arranged in the first flange plane, and the second flange part end region arranged in the second flange plane.

4. The high pressure fuel pump as claimed in claim 2, wherein each flange part defines at least one screw hole for guiding through a fastening bolt in the first and in the second flange part end region, the flange parts configured to facilitate the screw holes of the first flange part and the second flange part to overlap in the fastened state of the housing.

5. The high pressure fuel pump as claimed in claim 2, wherein each flange part is rotationally symmetrical about a center axis, the center axis dividing the flange part centrally between the first flange part end region and the second flange part end region.

6. The high pressure fuel pump as claimed in claim 1, wherein each flange part defines a partially circular recess for receiving the respective part circumferential region of the housing, a contact web for acting on the part circumferential region configured in the recess, the contact web extending in the recess.

7. The high pressure fuel pump as claimed in claim 6, wherein the contact web extends in the recess partially.

8. The high pressure fuel pump as claimed in claim 6, wherein the contact web extends over between 50% and 80% of the partial circle of the recess.

9. The high pressure fuel pump as claimed in claim 1, wherein, in the fastened state of the housing, each flange part extends over more than half of a circumference of the housing.

10. The high pressure fuel pump as claimed in claim 1, wherein the at least two flange parts are of identical configuration with respect to one another.

11. The high pressure fuel pump as claimed in claim 1, wherein, in the fastened state of the housing, the flange formed from the at least two flange parts surrounds a circumference of the housing completely.

12. The high pressure fuel pump as claimed in claim 1, wherein at least one of the housing comprises a circumferential projection, on which the at least two flange parts are supported, and the housing defines a groove of complementary configuration to a respective supporting region of the at least two flange parts, and the respective supporting region engaging with the groove.

* * * * *